US005195348A

United States Patent [19]

Del Fabro et al.

[11] Patent Number: 5,195,348

[45] Date of Patent: Mar. 23, 1993

[54] BENDING-SHAPING MACHINE FOR SECTIONS AND METHOD TO APPLY BENDS IN THE TRAILING END OF SECTIONS

[75] Inventors: Giorgio Del Fabro, Cassacco-Fraz.Montegnacco; Marcello Del Fabro, Udine, both of Italy

[73] Assignee: M.E.P. Macchine Elettroniche Piegatrici SpA, Reana Del Rojale (UD), Italy

[21] Appl. No.: 805,978

[22] Filed: Dec. 12, 1991

[30] Foreign Application Priority Data

Dec. 17, 1990 [IT] Italy ..... 83543 A/90

[51] Int. Cl.[5] ..... B21D 7/022

[52] U.S. Cl. ..... 72/294; 72/217; 72/307; 72/426

[58] Field of Search ..... 72/307, 306, 217-219, 72/149, 153, 388, 426, 419, 294

[56] References Cited

U.S. PATENT DOCUMENTS 2,453,868 11/1948 Shaw ..... 72/149
3,991,600 11/1976 Del Fabro ..... 72/217
4,049,026 9/1977 Del Fabro ..... 72/307
4,248,273 2/1981 Marcello ..... 72/217
4,993,253 2/1991 Del Fabro ..... 72/307

FOREIGN PATENT DOCUMENTS 3316917 11/1984 Fed. Rep. of Germany ..... 72/307

*Primary Examiner*—Daniel C. Crane
*Attorney, Agent, or Firm*—Antonelli, Terry, Stout & Kraus

[57] ABSTRACT

Bending-shaping machine for sections (29) in which a drawing unit (10) located downstream of a bending unit (35) and on the same axis as the section (29) takes up not only a retracted position (10B) and a normal working position (10L) but also a high position (10A) to lift the section (129) above an abutment roll (12). Method for the automatic bending of the trailing end of sections (29) in a bending-shaping machine as above described, in which so as to invert the orientation of a bend (26) when making bends (26) in the trailing end (C) of a section (129), the drawing unit (10) moves from its working position (10L) to its high position (10A) and returns to its working position (10L) while a bending disk (11) is displaced sideways (from position 11S to position 11D or viceversa) by passing under the section (129) and thus re-positioning the abutment roll (12) in relation to the section (129).

7 Claims, 5 Drawing Sheets

BENDING-SHAPING MACHINE FOR SECTIONS AND METHOD TO APPLY BENDS IN THE TRAILING END OF SECTIONS

BACKGROUND OF THE INVENTION

This invention concerns a method to apply bends in the trailing end of sections in an automatic or non-automatic bending-shaping machine by a bending unit positioned downstream of a unit that feeds sections.

A machine to which the invention is applied is disclosed in IT-A-15904 A/89 (EP-A-379043).

The bending-shaping machines to which the invention is applied have the purpose advantageously, but not only, of producing straight reinforcement bars including one or more bends in both ends of these bars. The machines can also have the purpose of bending hollow or solid sections of any type at both ends with bends having a clockwise and/or anticlockwise development.

The sections which can be bent with the bending-shaping machines to which this invention is applied may be pre-straightened, pre-straightened and sheared to size or unwound from rolls.

Document IT-A-15904 A/89 (EP-A-379043) discloses a bending-shaping machine with a bending unit, the machine feeding the sections continuously and being suitable to make the desired bends automatically in both ends of a section sheared to size.

This machine can make the bends in both ends of the section, but the making of clockwise and anticlockwise bends in the trailing end is effected with the same system as that employed for bends in the leading end, that is to say, when the bends are to be changed from clockwise bends to anticlockwise bends and viceversa, the bending unit is lowered and caused to pass beneath the section so as to be positioned on the other side of the section.

This system in itself is excellent but entails a great drawback as regards the times of the cycle required for this displacement; these times are deemed to be too long.

SUMMARY OF THE INVENTION

The present applicant has therefore tackled the problem of reducing, where possible, the downtimes caused by the repositioning of the bending unit in machines of the type of IT-A-15904 A/89 (EP-A-379043) and has obtained to his surprise the new method according to the invention, this method entailing a modification of the machine.

The method to bend the trailing end of sections in machines of the type disclosed in IT-A-15904 A/89 (EP-A-379043) is set forth and characterized in the main claim, while the dependent claims describe variants of the idea of the solution.

The invention has the purpose of making the desired bends automatically at the two ends of one or more sections, whereby the bends may be clockwise and/or anticlockwise.

Hereinafter we shall speak of a section but shall mean thereby that it is possible to bend one or more section at one and the same time.

The section to which this invention refers defines also a substantial distance between the two ends where the bends begin, and this distance is not less than at least half a meter.

According to the invention the section, already bent in a required manner at its leading end, is fed forwards until the whole straight length plus the length of the summation of the individual lengths of the bends to be made in the trailing end is defined at the shears.

When the section has reached that position, it is sheared and fed axially by the drawing unit downstream of the bending unit.

The bends are thus effected which are permitted by the present reciprocal positions of the bending unit and the section, clockwise bends for instance.

When the opposite bend, an anticlockwise bend for instance, has to be performed, the drawing unit is raised and takes with it the section, while the bending unit is repositioned by merely moving sideways.

The drawing unit is then lowered again so that the section is re-positioned in the bending unit, which can then make the inverted bend, which in this case is an anticlockwise bend.

This system is much quicker since it is much quicker to raise the drawing unit than to lower the bending unit.

In fact, the bending unit which can be raised and lowered and be displaced sideways at the same time weighs even as much as two hundred kilos or more, and therefore the forces involved become great and a high power is required.

Instead, the situation is different where the drawing unit has to be displaced vertically, for this unit may reach a weight of eighty to a hundred kilos at the most and therefore requires less power and shorter cycle times.

According to the invention the machine according to IT-A-15904 A/89 (EP-A-379043) is modified by arranging that the drawing unit located downstream of the bending unit may have three vertical positions in relation to the horizontal plane of the work platform, namely a first retracted position, a second position for cooperation with the section being bent and a third high position, which raises the section above the bending unit and frees the section of the constraint of the bending unit.

The first two of the above positions are known.

BRIEF DESCRIPTION OF THE DRAWINGS

Let us now see a preferred embodiment of the invention with the help of the attached figures, which are given as a non-restrictive example and show the following.

DESCRIPTION OF THE PREFERRED EMBODIMENTS

With the help of the attached figures let us now see the application of the invention to a specific bending-shaping machine according to IT-A-15904 A/89 (EP-A-379043) as adapted to perform the method.

Figure 1A:
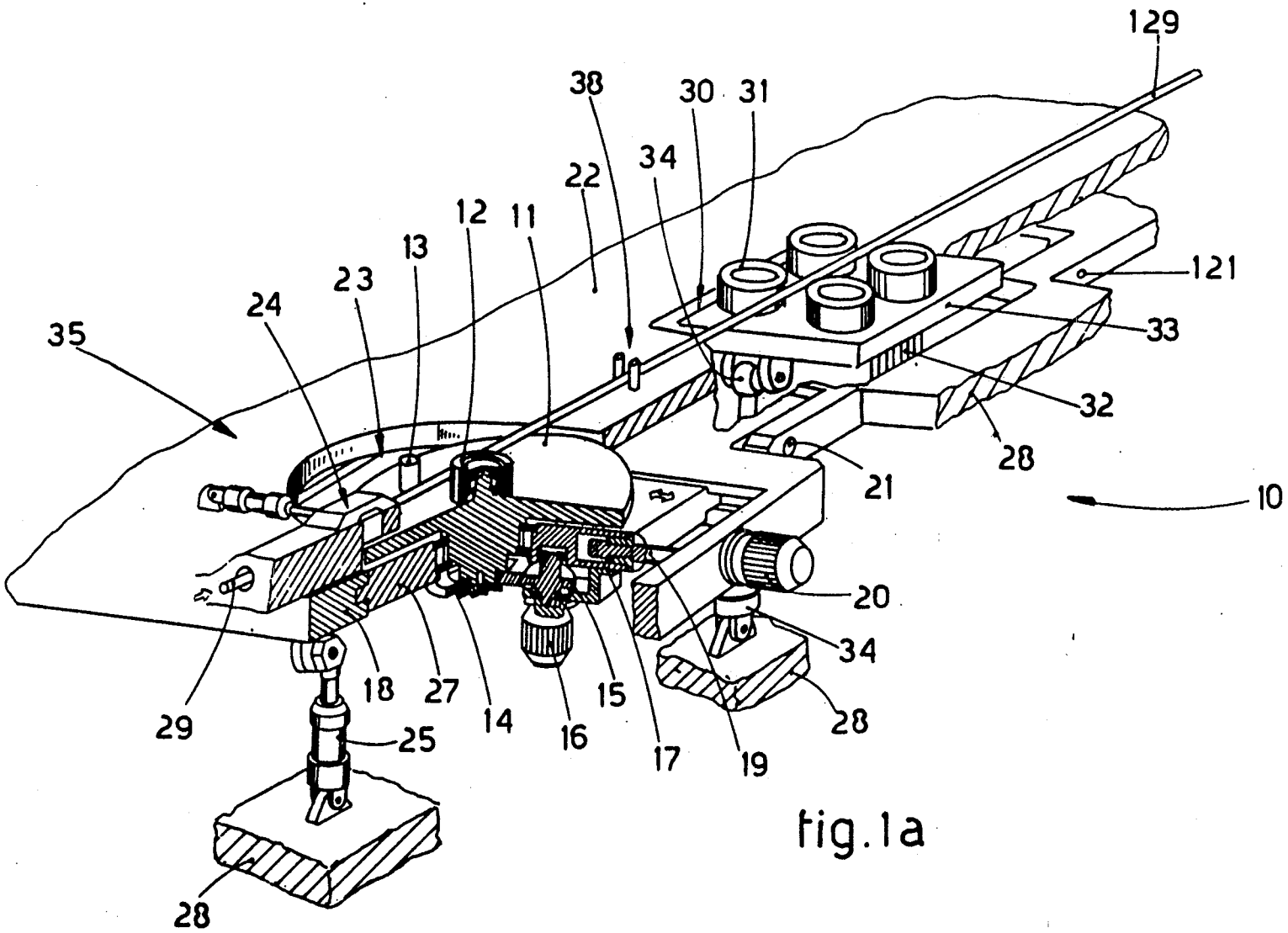
FIG. 1*a* is a partly cutaway, three-dimensional diagram of a portion of a possible bending-shaping machine that employs the invention.
Figure 1B:
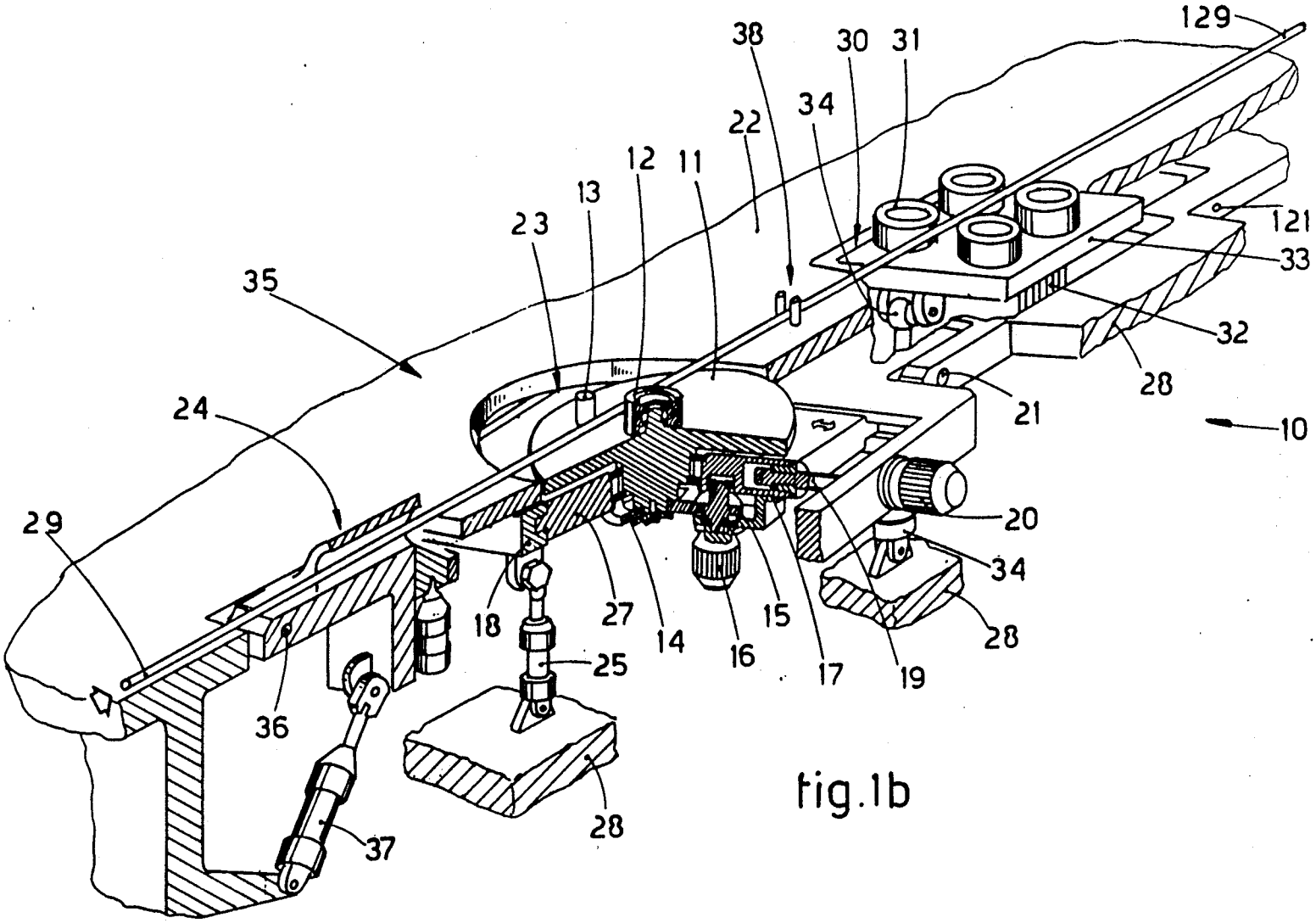
FIG. 1*b* is a partly cutaway, three-dimensional diagram of a portion of a possible bending-shaping machine that employs the invention but has a retractible shears.

In FIGS. 1*a* and 1*b*, a section 29 is fed continuously in a determined straightened form. In this example the section 29 being fed cooperates with a shears 24 located immediately upstream of a bending unit 35.

The bending unit 35 is of the type disclosed in IT-A-15904 A/89 (EP-A-379043) and is shown in FIGS. 1*a* and 1*b*.

The bending unit 35 comprises a bending disk 11 with an axial-abutment roll 12 and a bending pin 13.

The bending disk 11 is rotatably upheld by a slider 27, which can run in appropriate guides in a rocker base 18 and can take up in relation to the base 18 at least two positions, which are suitable respectively for clockwise bends and anticlockwise bends in the section.

The rocker base 18 is secured to a frame 28 able to provide rocking motion in a direction substantially at a right angle to a work platform 22 by means of a rocker pivot 21 positioned downstream of the bending disk 11. The rocking motion imparted to the rocker base 18 is produced in this case by means of a first cylinder/piston rocker actuator 25.

The rocker pivot 21 in this example is located downstream of the bending unit 35 and is substantially normal to the section 29 and parallel to the work platform 22.

The slider 27 is actuated by a first motor 20 of any desired type and the work platform 22 comprises a cavity 23 suitable to accommodate the bending disk 11 in the terminal positions of the latter 11.

In this case the first motor 20 drives a threaded shaft 19 which conditions the lengthwise position of the slider 27 in the rocker base 18 by means of a threaded bush 17.

The rotation of the bending disk 11 is achieved in this example by a driven gearwheel 14 actuated by a motive gearwheel 15, which in turn is driven by a second motor 16.

The means providing motion and also the transmission and/or drive means have been shown as an example so as to make the working of the invention clear.

A pair of pins 38 having abutment functions during the bending operations may be included immediately downstream of the bending unit 35; this pair of pins 38 is retracted when it is not required, namely during the steps of making bends in the leading end of the section.

A drawing unit 10 is comprised downstream of the bending unit 35 and cooperates with the nominal axis of the section 29 when the latter 29 is in the working position.

In this case the drawing unit 10 comprises drawing means 31, which in this example consist of rolls thrust, possibly resiliently, against each other so as to engage and draw forwards the section 29 according to requirements. These rolls 31 may have their axis normal or parallel to the work platform 22.

The drawing rolls 31 may be all or partly powered, for instance by a third motor 32 suitable for the purpose.

In this case the drawing rolls 31 have their axis normal to the work platform 22 and are upheld on a support 33 which in this example can rock at 121 together with the rocker pivot 21, which secures the support 33 to the frame 28.

The rocking motion of the support 33 is provided by a second cylinder/piston rocker actuator 34 or by another suitable means such as a cam or other means.

The support 33 is accommodated within a lodgement slot 30 machined in the work platform 22.

If the drawing unit 10 is brought fully below the work platform 22 (first retracted position), then a levelling closure may be provided to close the lodgement slot 30.

The support 33 can be move either with a rocking movement, as shown in the example, or with a vertical or inclined movement.

This movement of the support 33 according to the invention is suitable to position the drawing unit 10 in three vertical positions: a first retracted position (10B - FIG. 2), a second position for cooperation with the work platform 22 and with the section 29 (10L - FIGS. 1, 3, 4, 5 and 7) during bending operations and a third position (10A - FIG. 6) which displaces the section 29 above the bending unit 35.

Instead of the drawing rolls 31 there may be provided a caterpillar system with two facing tracks, or with one track and thrust rolls, or a gripper able to move along the axis of feed of the section 29.

All these variants are to be understood as operating with the above cited three vertical positions.

A stationary gripper may be included in cooperation with the movable gripper, or else two movable grippers may be comprised to work alternately so as to eliminate the downtimes of return movement.

A measurement unit is included in cooperation with the drawing rolls 31 and determines the length of the drawing of the section 29. This measurement unit, which is not shown in this example, takes into account the distance between the axis of the bending disk 11 and the position of the drawing unit 10.

FIG. 1*b* shows a shears 24 able to be retracted by rocking movement below the work platform 22. In this example the shears 24 is rocked on a pivot 36 by means of a third cylinder/piston rocker actuator 37.

By arranging that the shears 24 can be retracted, the length of the portions of the section to be bent sideways in the trailing end of the section "C" becomes free of structural conditioning by the bending-shaping machine.

Figure 2:
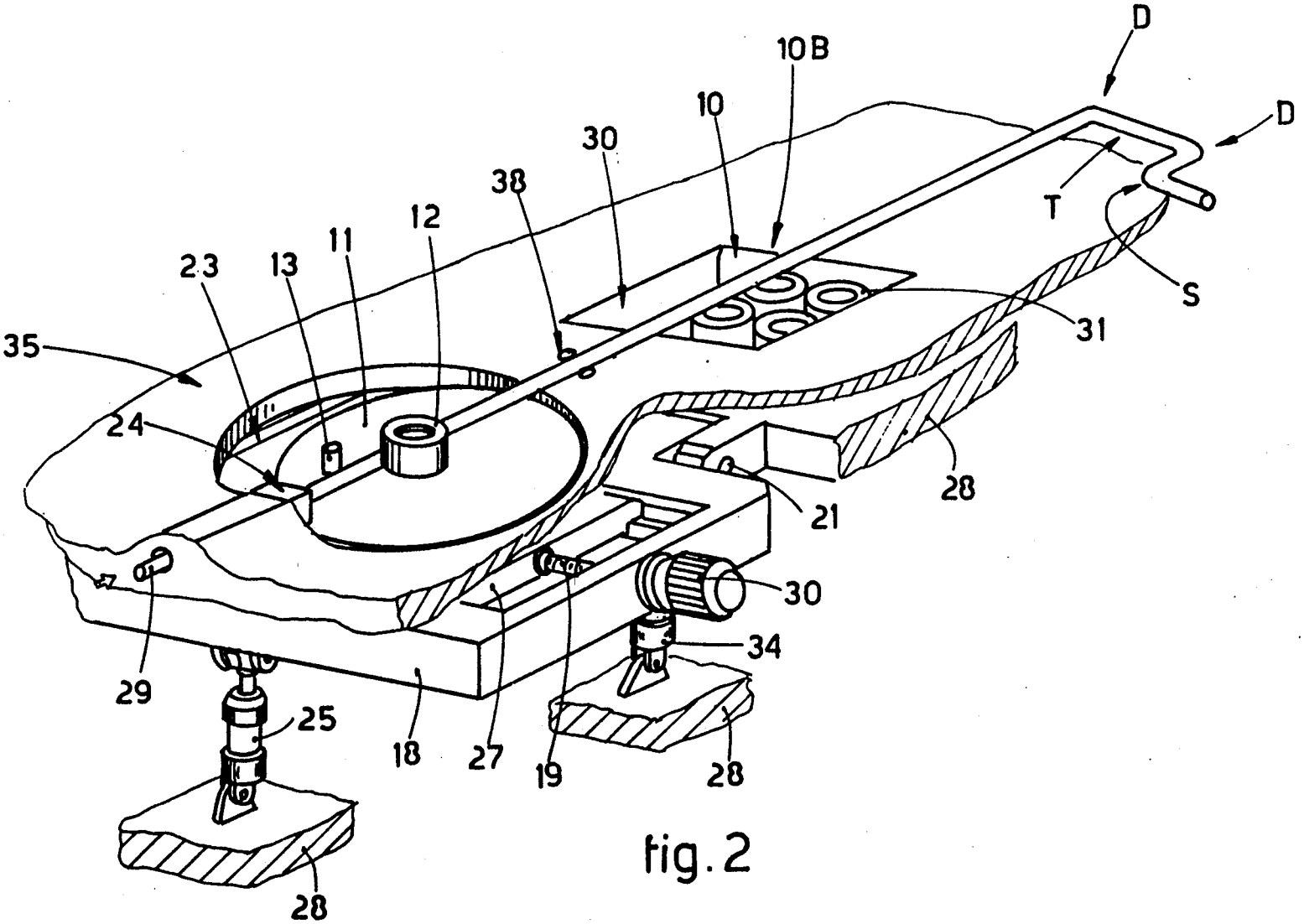
FIG. 2 shows the embodiment of FIGS. 1 with bends made in the leading end of the section.

As shown in FIG. 2, the bends are made in the leading end "T" of the section 29 while the section 29 remains one single whole connected to its leading end and is fed by known upstream drawing means, which are not shown here.

While bends are being made in the leading end "T" of the section 29, the drawing unit 10 located downstream of the bending unit 35 remains positioned below the work platform 22 and does not contact the section 29.

The section 29 is fed axially by the known drawing means positined upstream of the bending unit 35 and not shown here as they are not relevant for the purposes of the invention.

The bends in the leading end "T" of the section 29 are made by the bending unit 35, which, upon variation of the direction of bending from clockwise to anticlockwise or viceversa, is lowered, moves the abutment roll 12 sideways below the section 29, re-positions the abutment roll 12 on the other side of the section 29, is raised and performs the bend.

These operations are all part of the state of the art.

Figure 4:
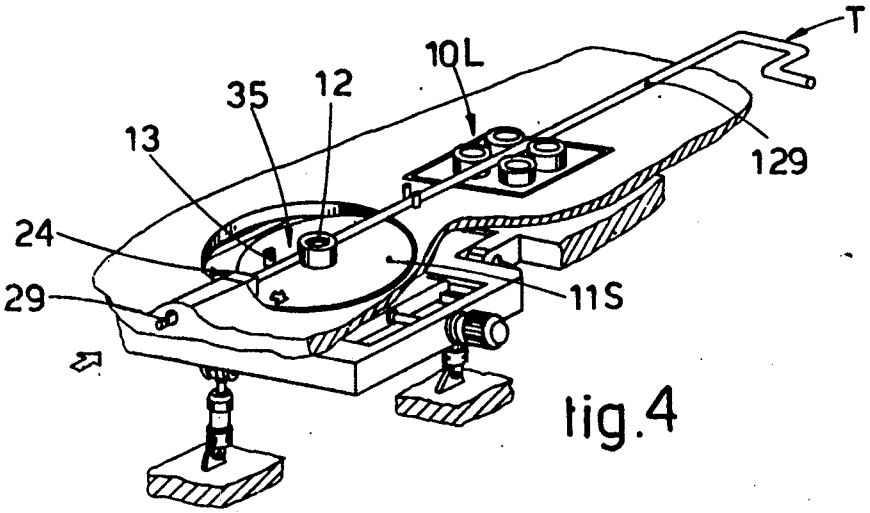
FIG. 4 shows the shearing to size of the section.

When the desired bends (whether clockwise "D" and/or anticlockwise "S") have been made in the leading end "T" of the section 29, the drawing unit 10 is positioned to cooperate with the work platform 22 and receives the section 29 as shown in FIG. 4.

With the section 29 in this position, the drawing unit 10 is in a condition to feed the section 29 axially as required.

When the section 29 has reached its required length, that is to say, when the leading end "T" of the section 29 has been distanced from the shears 24 by the pre-set length, the shears 24 shears the trailing end of the section 29 and thus determines a residual section 129, the leading end "T" of which already contains the bends required (FIG. 4).

Figure 3:
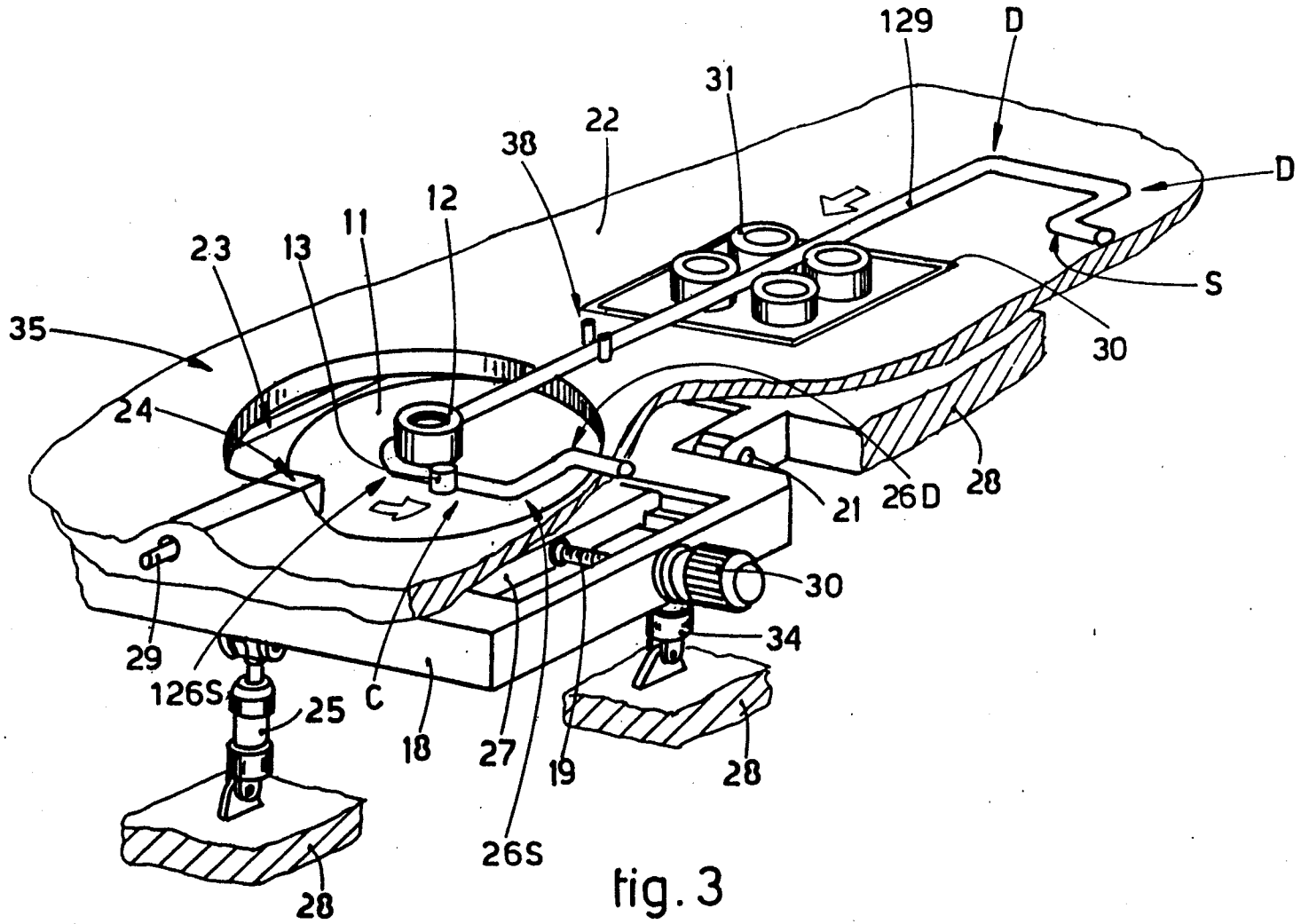
FIG. 3 shows the embodiment of FIG. 1 with a section in which the bends have been made in the trailing end too.
Figure 5:
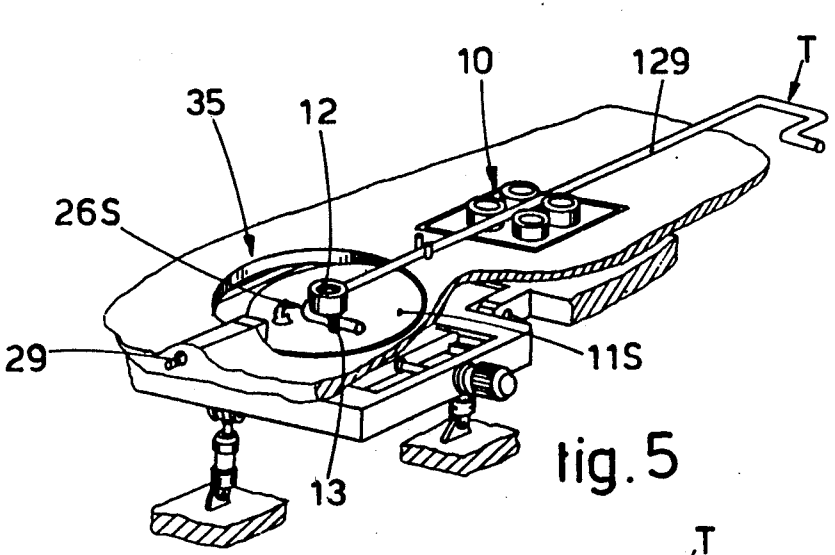
FIG. 5 shows the first bend in the trailing end of the section, the bend being anticlockwise.

In this position the drawing unit 10 positions the trailing end "C" of the residual section 129 and determines a first bend 26S therein without changing, in the example of FIG. 5, the position of the abutment roll 12 or, in the example of the first bend 26D of FIG. 3, after having changed beforehand the position of the abutment roll 12 in relation to the section 29.

FIG. 3 gives an example in which the trailing end "C" of the section 129 includes a first bend 26D, a second bend 26S and a third bend 26S, the only purpose being to show how and what can be obtained with the method according to the invention.

The steps of the method are shown in FIGS. 4 to 7, in which the first bend in the trailing end "C" is an anticlockwise bend 26S whereas the second bend 26D is a clockwise bend.

FIG. 4 shows the bending unit 35 with the bending disk 11 in position 11S, which enables clockwise bends to be made in the leading end "T" of the section 129 and anticlockwise bends in the trailing end "C".

Figure 7:
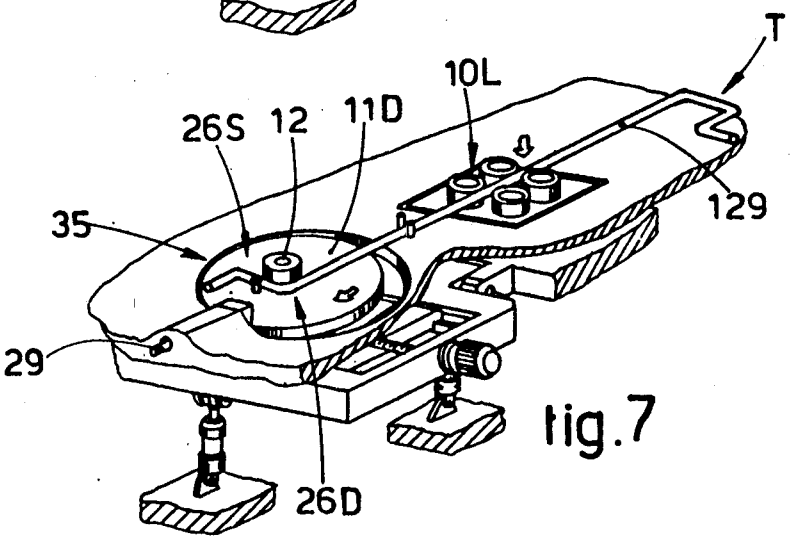
FIG. 7 shows the second bend, this time clockwise, in the trailing end of the section.

On the contrary, position 11D of the bending disk 11 in FIG. 7 enables anticlockwise bends to be made in the leading end "T" of the section 129 and clockwise bends to be made in the trailing end "C".

When the bending is inverted (from "S" to "D" or viceversa) during the performance of bends in the leading end "T" of the section 129, the bending unit 35 is lowered, displaces the disk 11 sideways and is then raised again, thus re-positioning the abutment roll 12 on the other side of the section 129.

Figure 6:
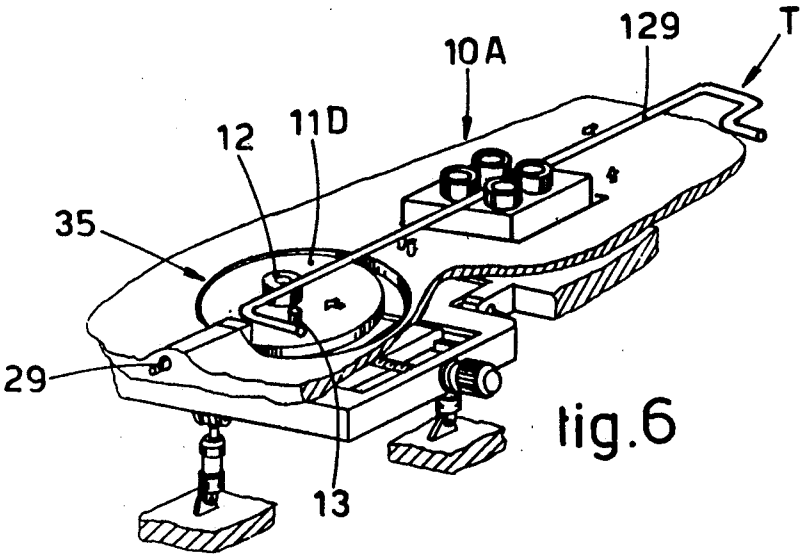
FIG. 6 shows the section freed from the constraint of the bending unit.

Instead, when the bending is inverted (from "S" to "D" or viceversa) during the performance of bends in the trailing end "C" of the section 129, the method according to the invention proceeds as follows with the use of FIGS. 5 to 7.

When the bend 26S has been made, it is necessary to make a bend 26D in the trailing end "C" of the section 129; in this case steps are taken to raise the drawing unit 10 from its position 10L (normal working position) to position 10A (high position), at the same time lifting the section 129 to a position higher than the abutment roll 12.

In this position the bending disk 11 can pass sideways below the section 129 without having to be lowered and raised, thus being moved from position 11S to position 11D in the example shown.

By this displacement the bending disk 11 is also moved from one side of the section 129 to the other side.

When the linear movement of the bending disk 11 has ended and the disk 11 has reached position 11D in this example, the drawing unit 10 returns from its high position 10A to its normal working position 10L and takes with it the section 129.

During these rising and lowering movements the section 129 can be displaced axially and be re-positioned for the next bend, so that when the section 129 has been re-positioned in relation to the abutment roll 12, a bend 26D can be made at once.

Moreover, if necessary, the bending pin 13 can be positioned in relation to the section 129 while the bending disk 11 passes from position 11S to position 11D or viceversa.

The vertical positioning of the drawing unit 10 can be carried out by a three-positional jack or by a threaded shaft or by a two-positional jack with positioner stops which set the exact vertical position of the drawing unit 10.

The positioner stops are of a type which can be actuated by pistons or electromagnets or coils or by means of cams positioned on a rotary shaft or with other analogous means.

According to a variant the drawing unit 10 can be of a type suspended from above, so that it has a working position and an upper retracted position; this upper retracted position can perform the functions of leaving the work platform free or of lifting the section 129 according to the method of this invention.

It is clear that the upper positions can also be two in number, one a retracted position and the other a lifting position.

We claim:

1. A bending-shaping machine for bending sections passing therethrough from an upstream and to a downstream end, comprising:

a working platform;

a bending unit cooperating with said working platform and comprising a rotatable bending disk having an axial abutment roll and a bending pin for bending the sections about the abutment roll;

a drawing unit provided upstream of said bending unit and being movable between a working position cooperating with said working platform to axially move said sections from said bending assembly in a downstream direction, a retracted non-working position below said working platform so that said drawing unit is out of operative engagement with said sections, and a high position above said working platform for lifting the sections above and out of operative engagement with said abutment roll.

2. A bending-shaping machine according to claim 1, further comprising means for displacing said bending disk in a direction normal to an axis of the sections and parallel to the working platform.

3. A bending-shaping machine according to claim 1, wherein said drawing unit comprises pairs of rolls, the rolls of each pair being thrust against each other so as to engage and move the sections in the downstream direction.

4. A bending-shaping machine according to claim 1, further comprising shears provided upstream of said bending unit and having a working position cooperating with said working platform and a retracted position below said working platform.

5. A method for the automatic bending of the trailing end of sections in a bending-shaping machine having a working platform, a bending unit cooperating with the working platform and comprising a rotatable bending disk having an axial abutment roll and a bending pin, and a drawing unit provided downstream of the bending assembly, the drawing unit having at least a working position cooperating with the working platform for feeding the section and a high position above the working platform for positioning the section out of operative engagement with said abutment roll and said bending pin, comprising:

axially moving a section by said drawing unit with said drawing unit in said working position;

rotating said bending disk in a first direction to make a bend in a trailing end of the section;

moving said drawing unit from said working position to said high position thereby lifting the bent section above the abutment roll;

displacing the bending disk in a direction normal to an axis of the section and parallel to the working platform to reposition the abutment roll from a first side of the section to an opposite side of the section;

lowering the drawing unit from the high position to the working position to located said opposite side of said section against the abutment roll; and rotating said bending disk in a second direction opposite the first direction thereby bending the trailing end of the section.

6. A method according to claim 5, further comprising axially repositioning the section with the drawing unit while the section is lifted above the abutment roll.

7. A method according to claim 5, further comprising rotating the bending disk to reposition the bending pin while the section is lifted above the abutment roll.

* * * * *